US005208585A

United States Patent [19]

Sprague

[11] Patent Number: 5,208,585

[45] Date of Patent: May 4, 1993

[54] HIGHWAY BARRIER FOR TRAFFIC CONTROL

[76] Inventor: R. Paul Sprague, 350 Indian Rock Rd., New Canaan, Conn. 06840

[21] Appl. No.: 822,725

[22] Filed: Jan. 21, 1992

[51] Int. Cl.[5] ..... B60Q 7/00; E01F 9/00; G08G 1/00

[52] U.S. Cl. ..... 340/908.1; 116/DIG. 16; 116/63 T; 40/610; 40/612; 404/6; 404/10

[58] Field of Search ..... 340/908.1; 116/63 P, 116/63 R, 63 C, 63 T, DIG. 16; 40/606, 610, 612; 404/9, 6, 10

[56] References Cited

U.S. PATENT DOCUMENTS

| | | | |
|---|---|---|---|
| 3,880,537 | 4/1975 | Harris et al. | 116/63 R |
| 4,394,843 | 7/1983 | Ediriwira | 116/63 P |
| 4,475,101 | 10/1984 | Kulp et al. | 340/908.1 |
| 4,674,431 | 6/1987 | Cory | 116/63 R |
| 4,739,302 | 4/1988 | Kinard | 340/908.1 |
| 4,973,190 | 11/1990 | Erwin et al. | 116/63 R |
| 5,058,300 | 10/1991 | Ernest et al. | 40/606 |

*Primary Examiner*—Jin F. Ng
*Assistant Examiner*—Nina Tong
*Attorney, Agent, or Firm*—Spencer E. Olson

[57] ABSTRACT

A portable highway barrier constructed of light weight material has an interior cavity which can be filled with a fluid ballast once it has been transported to a utilization site. The barrier has a box-like configuration defined by vertically-oriented side and end walls, the bottom portion of which is constructed to provide vertically-oriented slots each of which may function to support the lower edge of a vertically-oriented highway sign. The upwardly extending walls of a shallow well formed in the top of the barrier have apertures therein for facilitating attachment to the barrier of highway signs and/or other signalling or control devices such as warning lights. The barrier construction provides for attachment of connecting elements to its end walls so as to enable interconstruction of a plurality of barriers in end to end relationship for traffic channelization.

20 Claims, 3 Drawing Sheets

HIGHWAY BARRIER FOR TRAFFIC CONTROL

BACKGROUND OF THE INVENTION

This invention relates to a traffic control element and, more particularly, to a highway barrier for traffic control.

A variety of elements have been and are used for traffic warning, control and channelization, including drums made of metal or plastic, set on end, and usually marked with stripes of a color which contrasts from the color of the drum proper. The drums, whether metal or plastic, are usually provided with reflective surfaces and/or warning lights in accordance with the particular mode in which the drums are to be utilized. Plastic drums avoid the handling problems inherent in the use of metal barrels but, on the other hand, provide less structural integrity and weight but have the advantage of causing less motor vehicle damage or loss of control when impacted at high speeds. The lack of substantial weight of a plastic drum, however, requires that some means must be provided to stabilize the drum so that it will remain in an upright position or will return to its original upright position after impact, and to prevent it from being tipped and/or blown away by high winds.

While such barrel-type elements, including the barrel described in U.S. Pat. No. 4,083,033 which has a D-shaped configuration for preventing it from rolling when knocked to the ground, are widely used, they are not readily adapted for the support of temporary road signs for driver instruction and/or traffic control, with the consequence that other means must be provided for this purpose. Usually, temporary road signs are set up on easel supports as and when desired, and may also be provided with means for mounting a warning light or lights. Like the plastic barrel-type barrier, such an easel lacks substantial weight and when supporting a sign is easily tipped by a strong wind; accordingly, sandbags placed at the base of the easel are required to maintain the easel and the supported sign in an upright position. Because it is prone to tipping, such easels, whether supporting a road sign or not, are seldom used for traffic channelization but, instead, are limited to side of the road use.

Another popular traffic channelizing element is the traffic cone consisting of a lightweight hollow shell of conical shape provided with a rectangular base. Such traffic cones, unless weighted down by sandbags or other ballast are subject to being tipped by strong winds or impact. The usual cone is not provided with means for mounting a warning light thereon, nor does it provide means for supporting a road sign. While it is known from British patent application GB 2,182,701 A to mount a road sign on a traffic cone, the sign is specially designed to accommodate it to the cone. In one embodiment, the sign is provided with a loop which passes over the top of the cone, and in another embodiment the sign is provided with a prong which fits into the recess in the top of the cone.

It is evident from the foregoing that a need exists for an improved, relatively inexpensive, portable highway barrier that avoids the aforementioned problems and shortcomings of the prior art traffic channelizing elements. Therefore, a primary object of the present invention is to provide an improved portable highway barrier.

A further object of the present invention is to provide a portable highway barrier which is made of a lightweight hollow shell and which can be at least partially filled with a ballast material, such as water, or sand, at the utilization site.

A further object of the invention is to provide an improved highway barrier which includes means for supporting a temporary road sign.

Still another object of the invention is to provide an improved portable highway barrier, wherein the top surface is constructed to provide means for detachably securing one or more warning lights to the traffic barrier.

A further object of the invention is to provide an improved portable highway barrier which includes means at opposite ends thereof for permitting a plurality of the barriers to be connected to one another in end to end relationship.

SUMMARY OF THE INVENTION

Broadly, the highway barrier according to the present invention comprises an elongated box-like hollow shell constructed of a resilient, plastic material. One or more fill openings are provided in the top of the barrier for providing access for the insertion of a fluid ballast material into the shell, and the end walls have drain holes which can be opened to permit the fluid material to be drained and removed from the shell.

The barrier has a rectangular cross-sectional configuration defined by a pair of parallel side walls, a pair of parallel end walls and top and bottom walls, and along its lower edge has vertically-oriented slots disposed parallel to and spaced outwardly from respective end and side walls each for supporting the lower edge of a highway sign. The top wall is positioned below the top edges of the side and end walls so as to form a well in the top of the barrier in which one or more warning lights may be supported and detachably secured by a bracket. Connector elements attached to each end wall of the barrier permit a multiplicity of the barriers to be temporarily connected together end to end.

Other objects, features and advantages of the invention will become apparent, and its construction and utility better understood, from the following detailed description, read in conjunction with the accompanying drawings.

DETAILED DESCRIPTION OF THE PREFERRED EMBODIMENT

Figure 1:
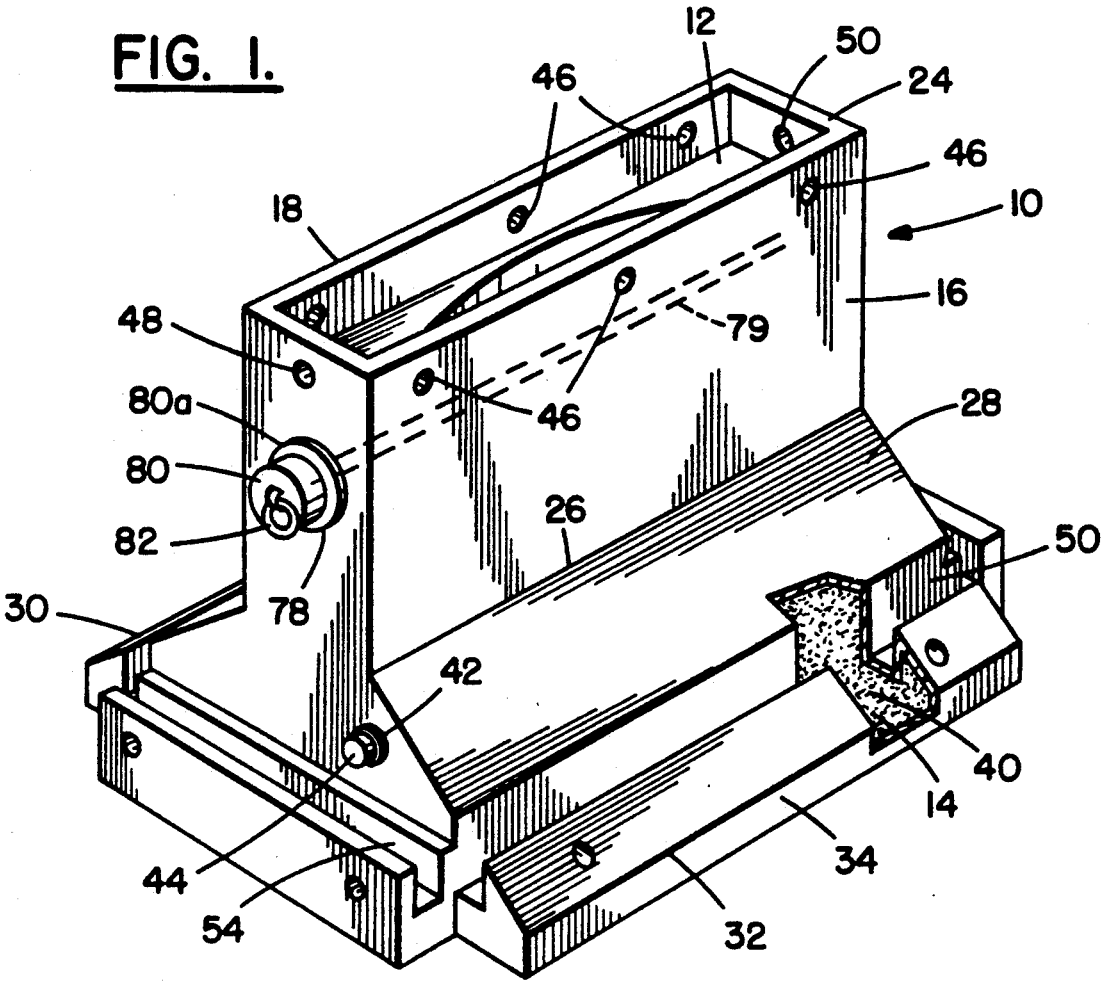
FIG. 1 is a perspective view, partially cut away, of a highway barrier constructed in accordance with the present intention.

Referring to the drawings, the numeral 10 generally designates the highway barrier element of the present intention. The barrier element has a box-like rectangular cross-sectional configuration defined by a top wall 12, a bottom wall 14, opposite parallel, vertically-oriented side walls 16, 18 and opposite parallel, vertically-oriented end walls 22, 24. The width of top wall 12 is substantially less than the width of the bottom wall 14 so that an upper portion of side walls 16, 18 each extend downwardly from its top edge and then diverts downwardly and outwardly from a lower edge 26 to define an inclined wall 28, 30 and at the lower edge 32 extends vertically downward at 34, 36 and is integrally joined to bottom wall 14 at its lower edge. The body element 10 is constructed of a resilient, plastic material, such as a high density linear polyethylene material, preferably by a rotational molding process, to have a hollow construction which defines a cavity which extends throughout the length of the barrier. By way of example, the barrier element may have an overall length of about 4.5 feet, and overall height of about 3.5 feet, an upper portion width of about 1.0 foot and a bottom wall width of about 3.0 feet. Top wall 12 is provided with one or more access openings 38 to allow access for loading into the element of a fluid ballast such as water or granulated sand for stabilizing the barrier in an upright position. The fact that the bottom of the interior cavity is wider than the top causes the ballast 40 to have a low center of gravity, thereby imparting stability to the barrier and helping to prevent tipping. The end walls 22, 24 are each provided with one or more drain openings 42 in which are inserted drain caps 44, the drain holes being located near bottom wall 14 so as to provide adequate drainage. If necessary, the barrier element may be tipped up on one end, or upside down, to insure complete removal of the ballast.

Top wall 12 is integrally joined to the side and end walls and is positioned downwardly from their top edges so as to form a shallow well at the top of the barrier; in a barrier having the aforementioned dimensions the well may be on the order of 4 to 6 inches deep. Three apertures 46 are distributed along the upstanding portions of side walls 16 and 18 and an aperture 48 is provided in the upstanding portion of each end wall 22, 24. As will be seen, these apertures facilitate mounting one or more warning lights in the well, or securing a road sign to the barrier.

Vertically-oriented slots 50 and 52, each about 2½" wide, are provided in the inclined wall portions 28, 30, respectively, each being parallel to and spaced outwardly from its respective side wall 16, 18, and which may function to receive and support the lower edge of a highway traffic sign. Similarly, a vertically oriented slot 54, 56 is provided near the bottom of each end wall 22, 24, respectively, each being parallel to and spaced outwardly from a respective end wall. The availability of four slots provides the freedom to choose the side of the barrier which is the most convenient, in a particular situation, for attaching a sign.

Figure 3:
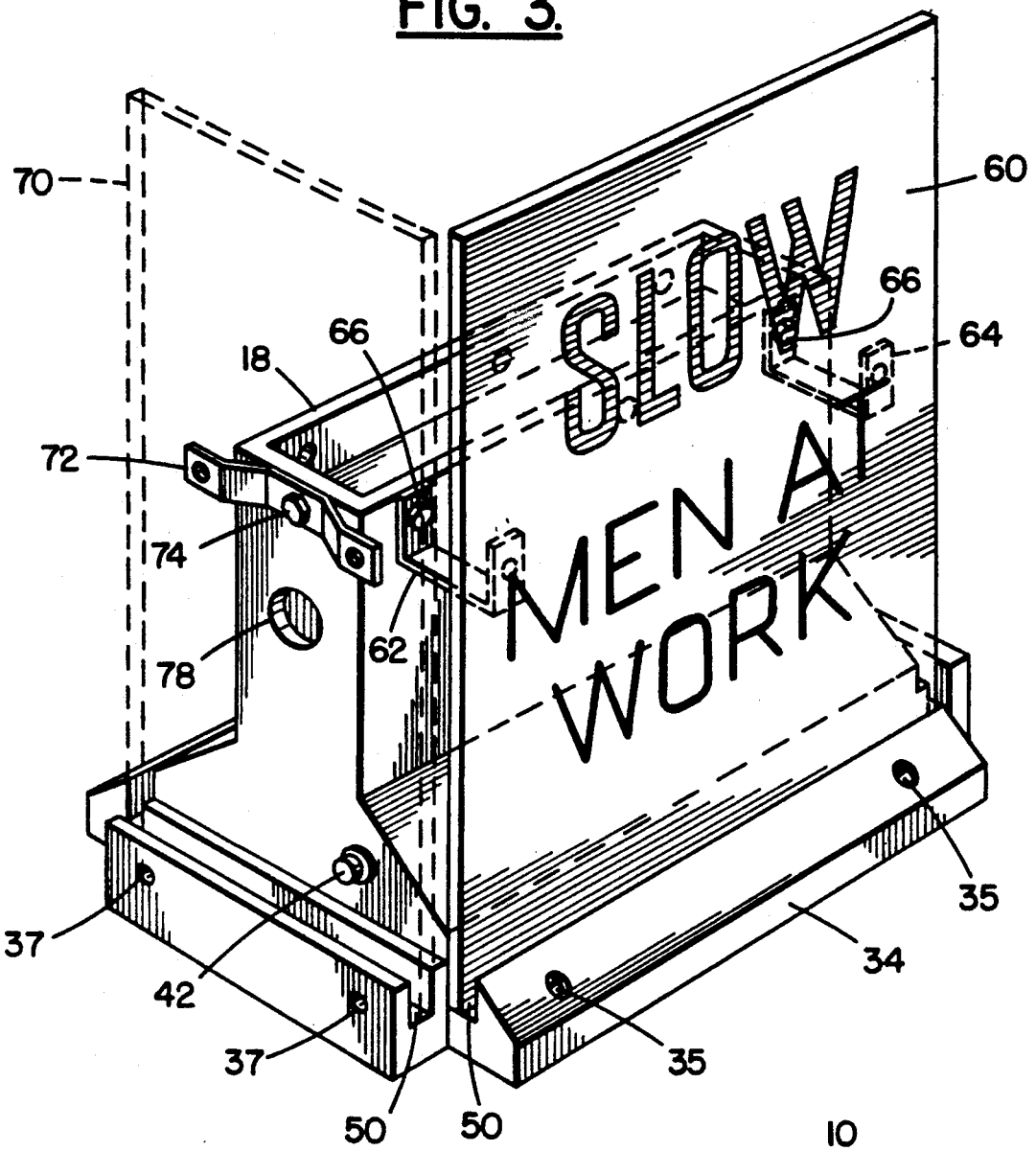
FIG. 3 is a perspective view depicting how highway signs may be supported on the barrier.

For example, as shown in FIG. 3, a rectangular sign 60 having a length about the same as the barrier has its lower edge supported in slot 50 and its upper portion is detachably secured to side wall 16 of barrier 10 with a pair of U-shaped brackets 62 and 64, one leg of each of which is attached to side wall 16 with suitable fastening means, such as a bolt 66 which passes through an opening in the bracket leg and one of the openings 46 and secured with a threaded nut, and the other leg of each bracket is similarly attached to the sign 60. The shallow well at the top of the barrier provides ready access to the portion of the fastening means that extends through the wall, thereby facilitating attachment and removal of the highway sign. If desired, a sign of the same general size and shape as that of sign 60 may be similarly supported in parallel spaced relationship with the opposite side wall 18, and alternatively or in addition, another sign 70 may be supported at its lower edge in slot 54 with its upper portion detachably secured to the barrier with a bracket 72 bolted to the sign and also to the barrier element.

The bottom portion of sign 60 may be held in place in slot 50 by a pair of threaded bolts 35 which pass through holes formed in wall portion 34 and threaded at the inner end, and through holes formed along the lower edge of the sign, for threaded engagement with the inner end of the hole. One or two holes 37, similar to those in wall 34, may be provided near the lower edge of each end wall, for receiving a bolt or bolts for detachably securing the lower edge of a sign 70 in slot 50.

Figure 2:
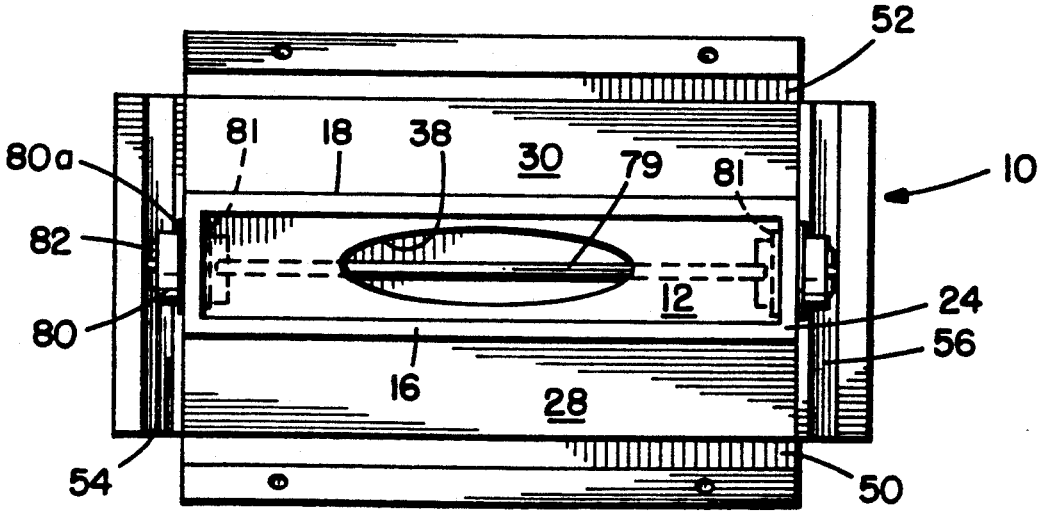
FIG. 2 is a top plan view of the barrier.

Each end wall 22, 24 has a circular opening 78 therein in which connecting means are attached for connecting two or more elements together end to end. As can be seen in FIGS. 1 and 2, the connecting means attached to each end wall may comprise a short cylindrical element 80 which are mechanically connected together by a metal rod 79, preferably steel, which extends lengthwise of the barrier. The outer end of element 80 projects out from its respective end wall a distance sufficiently short as not to interfere with attaching a highway sign to the end wall in the manner shown in FIG. 3. For removable attachment to the end wall, each cylindrical element 80 may be provided with an integral flange **80*a* of slightly larger diameter than aperture 78 which is drawn into engagement with the outer surface of the wall by a flanged threaded nut 81 of similar diameter which threadably engages the inner end of element 80. The opening 38 in to wall 12 provides convenient access to the interior flanges 81. Each cylindrical element 80 has a ring 82 pivotally attached to its outer end so as to normally assume the position shown in FIG. 1**.

Figure 4:
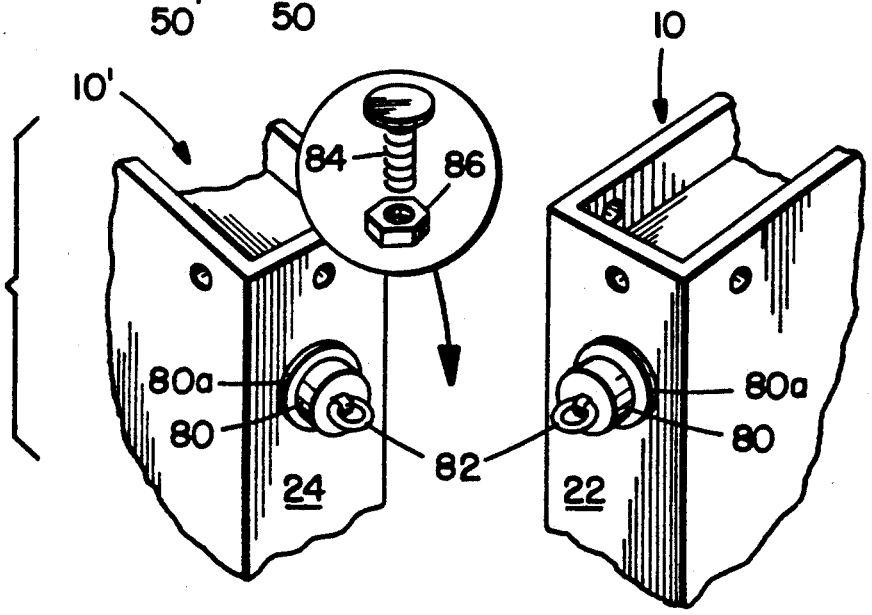
FIG. 4 is a fragmentary perspective view showing two barriers placed end to end and means for detachably connecting the barriers together.
Figure 5:
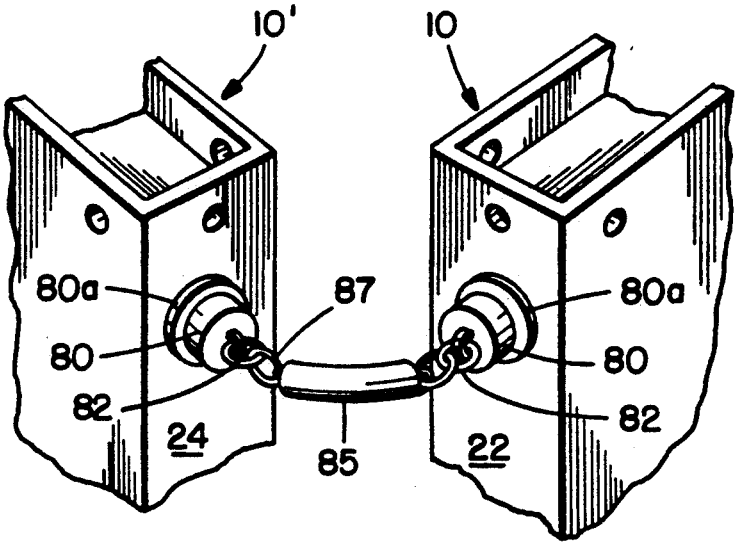
FIG. 5 is a fragmentary perspective view of two barriers placed generally end to end and showing alternative means for temporarily interconnecting the barriers.
Figure 6:
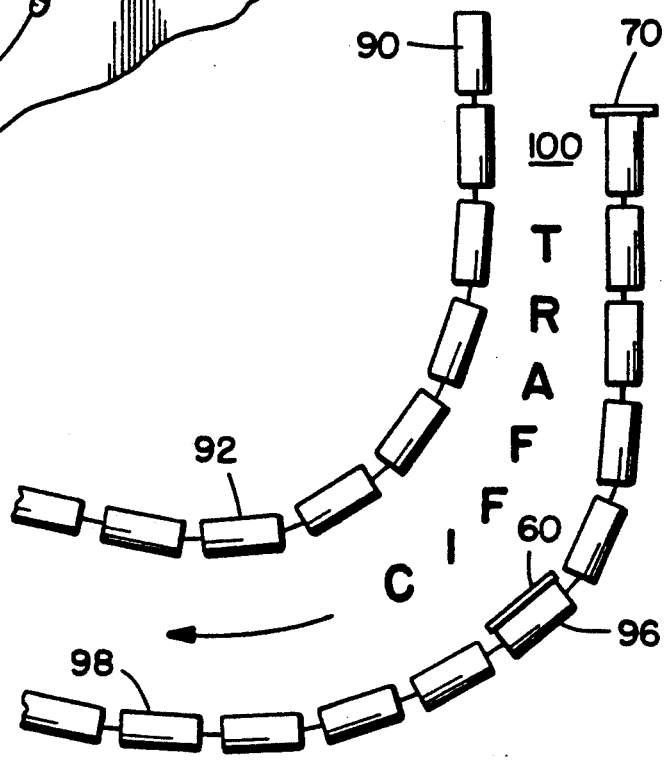
FIG. 6 is a top plan view of two sets of barriers placed in end to end relationship for defining a channel where traffic may travel.

Referring to FIG. 4, which depicts an upper corner portion of confronting end walls 22 and 24 of similarly constructed barrier elements 10 and 10', the barrier elements may be temporarily connected together end to end by passing a threaded bolt through the rings 82 of the confronting connectors and securing the bolt with a threaded nut 86. Because the elements 80 project only a short distance from the end wall, and the size of the rings 82 is also limited, permits end to end interconnection of a multiplicity of barriers only if they are arranged in a generally straight line. Should it be necessary to turn a corner with a multiplicity of interconnected barriers, for example to define a curved traffic lane, this limitation is overcome by inserting an extender 85 between the connectors attached to the confronting end walls 22 and 24 of the barrier elements 10 and 10', as shown in FIG. 5. The extender may comprise a metal rod, preferably steel, having a ring 87 pivotally attached to each end, which each may be removably secured to the ring 82 of a respective connector. The extender has a length to permit interconnected barrier elements to be positioned at any desired angle relative to each other without interference, thus enabling a plurality of barrier elements 90, 92, 94, 96 and 98 to be placed in end to end interconnected relationship along a curved path on a roadway, as depicted in FIG. 6, for defining a channel 100 for controlling vehicular traffic. Barrier element 94, at the entrance to the channel, may have a sign 70 supported on an end wall carrying instructions to motorists as they enter the channel, and one or more of the barrier elements, such as barrier 96, may have a further instructional sign 60 supported on its side wall that faces oncoming traffic. Because of the ease with which highway signs can be attached to and removed from the barrier, it is convenient to attach signs to those barrier elements of a particular configuration of interconnected elements to optimize guidance to the motorist.

Figure 7:
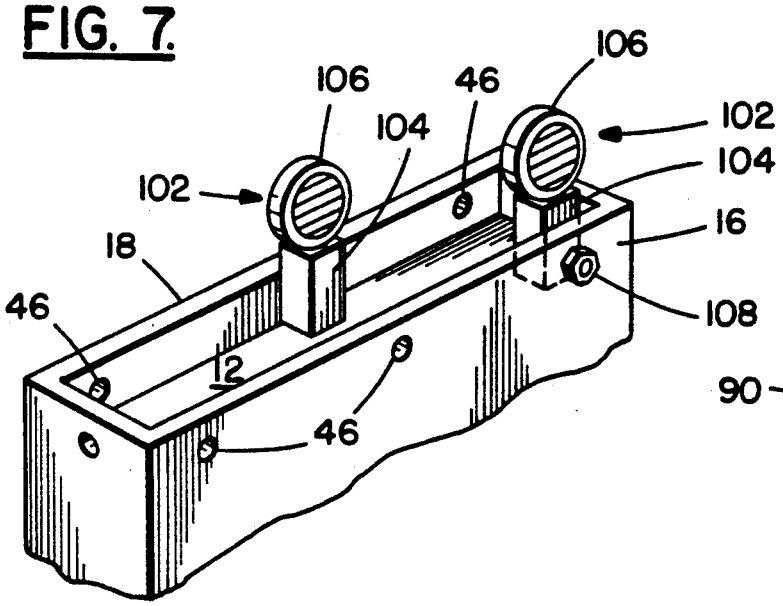
FIG. 7 is a fragmentary perspective view of the upper portion of the barrier showing how warning lights may be mounted on the barrier.

Top wall 12 and the surrounding upstanding side and end walls together also provide structure for accepting and storing a commercially available warning or blinker light 102 which may comprise a battery housing 104 for the warning light 106. As seen in FIG. 7, the generally rectangular battery housing 104, which has a height generally corresponding to the depth of the well, may be supported on top wall 12 and secured to the upstanding wall of the well at any of the locations of the holes 46 by inserting the bolt normally provided on the housing through a selected opening 46 and securing it with a threaded nut 108. Depending on requirements, one or more warning lights can be attached in the same way.

When not in use, the barrier element 10 and other similarly defined barrier elements are kept empty of fluid material so as to be light in weight and normally are stored in that condition. When needed at a construction site, they are transported empty to the site and once in place may be filled with water, sand or other fluids to provide ballast and additional weight. When placed in an upright position on a roadway surface, the low center of gravity of the ballasted barrier element gives the barrier element stability and helps to prevent tipping by high winds even when supporting a relatively large area highway sign. After a barrier has served its purpose at a particular site, the drain cap 44 is removed to permit the ballast material to drain out of the inner cavity, after which the barrier can be easily lifted and loaded onto a vehicle for transport to storage or to another construction site.

The barrier element 10 may be relatively inexpensively manufactured from lightweight materials such as plastics because the configuration minimizes the amount of material required for its fabrication. The use of a polyethylene plastic material allows fabrication of the highway barrier by rotational molding practices.

The flat vertical surfaces of the barrier element may be provided with surfaces areas that contrast in color with the basic color of the traffic barrier. The contrast may be provided by means of strips of commercially available sheeting adhesively secured to the barrier, preferably reflective sheeting material for night time use.

Various modifications of the above-described embodiment of the invention will be apparent to those skilled in the art, and it is to be understood that such modifications can be made without departing from the scope of the invention if they are made within the spirit and tenor of the accompanying claims.

I claim:

1. A highway barrier comprising a hollow box-like element adapted for temporary placement on a surface in an upright position for traffic signalling and channelization, said element being constructed of a resilient plastic material and having a rectangular cross-sectional configuration defined by a pair of parallel vertically-oriented end walls and a pair of generally vertically-oriented sidewalls integrally joined at opposite ends to said end walls, and top and bottom walls integrally joined to said side and end walls, a bottom portion of said box-like element being constructed to provide vertically-oriented slots exteriorly of, coextensive with and parallel to at least each side wall, each of which slots is dimensioned to accept and support a traffic sign in an upright position.

2. A highway barrier as defined in claim 1, wherein said bottom portion of said box-like element is constructed to further provide a vertically-oriented slot exteriorly of, coextensive with and parallel to each end wall.

3. A highway barrier as defined in claim 1, wherein said top wall includes means for allowing access for the loading of ballast into the element for stabilizing the element in an upright position.

4. A highway barrier as defined in claim 3, wherein the top wall of said element is provided with an aperture through which ballast may be loaded into the element.

5. A highway barrier element as defined in claim 4, including means in at least one wall for draining ballast from the element.

6. A highway barrier as defined in claim 5, wherein at least one end wall of said element has a hole therethrough located in close proximity to said bottom wall and means for normally closing said hole.

7. A highway barrier as defined in claim 1, wherein the top of said element is constructed and defined to provide means for mounting at least one warning light on said barrier.

8. A highway barrier as defined in claim 1, wherein an upper portion of each side and end wall extends above said top wall so as to provide means for attaching to the barrier the upper portion of a highway sign supported along its lower edge in a respective vertically oriented slot.

9. A highway barrier as defined in claim 8, wherein said extending upper portion of each wall has openings therein for receiving fastening means for releasably securing one or more warning lights supported on the top wall of said element.

10. A highway barrier as defined in claim 1, wherein each end wall of said element is constructed and defined for providing means to attach connecting means thereto for connecting said element to another similarly defined element.

11. A highway barrier as defined in claim 10, including a second similarly defined barrier positioned end to end, connecting means attached to each confronting end wall, and detachable connector means for joining said connecting means together for temporarily interconnecting said barrier and said second similarly defined barrier element.

12. A highway barrier element as defined in claim 11, wherein the upper portion of each end wall has an aperture therein, wherein said connecting means attached to each said end wall comprises a cylindrical element an outer end of which projects from said aperture and an inner end of which is connected to the inner end of the cylindrical element attached to the opposite end wall with a rod which extends lengthwise of the barrier, and a ring pivotally connected to the outer end of said element, and wherein said connector means comprises fastening means for connecting the ring of the connecting means at one end of the barrier to the ring of the connecting means at the end of the confronting barrier.

13. A portable hollow highway barrier comprising a box-like element adapted for temporary placement on a surface in an upright position for traffic control and channelization, said element being constructed of a resilient plastic material and having an upper portion of rectangular cross-sectional configuration defined by a pair of vertically-oriented side walls, a pair of vertically-oriented end walls integrally joined to said side walls and a top wall integrally joined to said side and end walls at a distance below their upper edges so as to form a shallow well in the top of said barrier surrounded by upwardly extending side and end walls, and having a bottom portion including a rectangular bottom wall having a length substantially coextensive with said side walls and a width greater than the end walls of said upper portion and inclined side walls diverging outwardly and downwardly from the side walls of said upper portion and integrally joined to respective side edges of said bottom wall, said bottom portion being constructed and defined for providing a vertically-oriented slot exteriorly of and parallel to each end wall and a vertically-oriented slot in each inclined side wall and substantially parallel to the side walls of said upper portion, each of which slots is constructed to receive and support a highway sign in an upright position.

14. A highway barrier as defined in claim 13, wherein said top wall has an aperture therein through which ballast may be loaded into the interior of said element, and wherein at least one of said end walls has a hole therethrough located in close proximity to the bottom wall for draining ballast from the element and means are provided for normally closing said hole.

15. A highway barrier as defined in claim 13, wherein said upwardly extending end and side walls have apertures therethrough for receiving fastening means for securing signalling or channelizing devices to the barrier.

16. A highway barrier as defined in claim 15, further including bracket means and fastening means insertable through one or more of the apertures in said upwardly extending walls for releasably securing to said barrier an upper portion of a highway sign supported at its lower edge in a respective slot.

17. A highway barrier as defined in claim 15, further including a warning light supported on the upper surface of said top wall and secured to the barrier by means including a selected one of said apertures.

18. A highway barrier as defined in claim 13, wherein each end wall of the element is constructed and defined for providing means to attach connecting means thereto for enabling said element to be interconnected with another similarly defined element.

19. A highway barrier as defined in claim 18, including a second similarly defined barrier element positioned end-to-end with said barrier element, connecting means attached to each confronting end wall of said elements, and detachable connector means for joining together said connecting means for temporarily interconnecting said barriers.

20. A highway barrier as defined in claim 18, wherein the upper portion of each end wall has an aperture therein, wherein said connecting means comprises a cylindrical element which projects from said aperture and is attached to the end wall and a ring pivotally attached to the outer end of said cylindrical element, and wherein said connector means comprises fastening means for connecting the ring of the connecting means at one end of the barrier to the ring of the connecting means at the end of the confronting barrier.

* * * * *